United States Patent [19]

Takeda et al.

[11] Patent Number: 4,664,086

[45] Date of Patent: May 12, 1987

[54] AIR-FUEL RATIO CONTROLLER FOR INTERNAL COMBUSTION ENGINE

[75] Inventors: Yuji Takeda; Toshio Suematsu; Osamu Harada; Katsushi Anzai, all of Toyota, Japan

[73] Assignee: Toyota Jidosha Kabushiki Kaisha, Aichi, Japan

[21] Appl. No.: 837,590

[22] Filed: Mar. 7, 1986

[30] Foreign Application Priority Data

Mar. 7, 1985 [JP] Japan ..... 60-45391

[51] Int. Cl.[4] ..... F02M 51/00

[52] U.S. Cl. ..... 123/489

[58] Field of Search ..... 123/440, 478, 489

[56] References Cited

U.S. PATENT DOCUMENTS

| | | | |
|---|---|---|---|
| 4,478,193 | 10/1984 | Watanabe | 123/489 |
| 4,498,445 | 2/1985 | Hasegawa et al. | 123/489 |
| 4,517,949 | 3/1985 | Ito et al. | 123/489 |
| 4,539,958 | 9/1985 | Ito et al. | 123/440 |
| 4,542,729 | 9/1985 | Yamato et al. | 123/489 X |
| 4,570,599 | 2/1986 | Hasegawa et al. | 123/489 |
| 4,589,390 | 5/1986 | Wazaki et al. | 123/489 X |

*Primary Examiner*—Willis R. Wolfe, Jr.
*Attorney, Agent, or Firm*—Kenyon & Kenyon

[57] ABSTRACT

An apparatus of controlling an air-fuel ratio for internal combustion engine, further comprising the steps of calculating a basic fuel injection duration based on an engine load and a rotational speed of the engine, obtaining a factor of air-fuel ratio feedback correction for allowing a fuel injection duration to perform a proportional-plus-integral action, based on an output of an oxygen sensor for detecting an residual oxygen concentration in an exhaust gas, calculating a mean value of said factor of air-fuel ratio feedback correction, varying a correction value by learning so that said mean value takes a value within a predetermined range centered at a predetermined value corresponding to a target air-fuel ratio, multiplying said mean value by said correction value, providing initial adjustment of load detection apparatus applied to said internal combustion engine for determining said basic fuel injection time duration in order to set said calculation result within said predetermined range, and obtaining the fuel injection duration based on said basic fuel injection duration, said factor of air-fuel ratio feedback correction and said correction value, thereby, to control the air-fuel ratio.

4 Claims, 10 Drawing Figures

METER OF INITIAL ADJUSTMENT
ECU
SPEED SENSOR
1
2
3
4
5
6
7
8
9
10
11
14
15
16
17
18
19
20
26
28

AIR-FUEL RATIO CONTROLLER FOR INTERNAL COMBUSTION ENGINE

BACKGROUND OF THE INVENTION

1. Field of the invention

The present invention relates to air-fuel ratio controller for an internal combustion engine, more specially, air-fuel ratio initial control for the internal combustion engine which controls air-fuel ratio by feedback based on the multiplication of a basic fuel injection duration determined by the load of the engine and engine speed, an air-fuel ratio feedback correction coefficient obtained by output signal of an oxygen sensor and a learning value which is variable so that the mean value of air-fuel ratio feedback correction coefficient is remained whithin the measure value preset range.

2. Prior Art

Generally, three-way catalyst has been used for simultaneous purification of carbon monoxide, hydrocarbon and nitrogen oxide in exhaust gas. To improve purification ratio of the catalyst, feedback control is applied to presume and control the air-fuel ratio to be in the vicinity of stoichiometric air-fuel ratio by detecting the concentration of residual oxygen in exhaust gas. To operate the feedback control, the fuel injection interval TAU is to be obtained by the multiplication of a basic fuel injection interval TP determined by the load of the internal combustion engine (intake pressure PM or intake air amount A/Ne per revolution) and engine speed, and air-fuel ratio feedback correction coefficient FAF, as shown in FIG. 6 which proportionaly integrate the fuel injection time interval according to the air-fuel ratio signal generated and processed by the signal from the oxygen sensor, which provides the opening position of the fuel injeciton valve during the time equivalent to that of TAU to control the air-fuel ratio in the vicinity of the stoichiometric air-fuel ratio. The above stoiciometric air-fuel ratio feedback correction coefficient FAF delays to overtake the rapid change of the internal combustion engine operation, which causes the period when the air-fuel ratio is off the target air-fuel ratio. Changes in environment or lapse have caused variations of valve timing due to the variation of tapet clience, characteristics of pressure sensor, air-flow meter and fuel injection valve, which might fail in controling the fuel injection volume to the required volume for the engine to control the air-flow ratio in the vicinity of the stoichiometric air-flow ratio. To solve the problem, learning control for air-fuel ratio is adopted to remain the air-fuel ratio in the vicinity of the stoichiometric air-fuel ratio. As shown in the following, the learning control adjusts the mean value of the air-fuel ratio feedback correction coefficient FAFAV to be preset value with learning value KG learned by the given condition $$TAU = TP \times KG \times FAF(1 + F(t))$$

where F(t) stands for the correction coefficient of increment of warming up or starting and is set up to 0.0 in feedback controlling of air-fuel ratio. The learning value KG is learned and updated every section according to the load of the internal combustion engine, for example, when intake air amount is 15–30 l/h, 30–45 l/h or 45 l/h–60 l/h, it is learned as KG1, KG2, and KG3, respectively.

These learning values KG (KG1, KG2, KG3) are learned with the following method whenever the correction coefficient FAF skips preset times in air-fuel ratio feedback controlling and cooling water temperature exceeds the preset value (for example, 80°). At first whenever air-fuel ratio feedback correction coefficient FAF skips preset times, the arithmetrical mean FAFAV of the maximum/minimam value of FAF is to be obtained as follows:

$$FAFAV = (A+B)/2, (B+C)/2, (C+D)/2 \quad \ldots (2)$$

When the mean value FAFAV becomes out of the preset range (for example, a range of ±2% to the value of the stoichiometric air-fuel ratio), learning value KG isadjusted to be given value by learning. When a mean value FAFAV is above 1.02, the learning value KG is increased to a given value and the mean value FAFAV is below 0.98, the learning value KG is decreased to the given value.

The above-mentioned learning value KG applied to above equation (1) dependent on wheather the intake throttle valve is open or closed and intake air amount per revolution of internal combustion chamber, which provides TAU. As a result, when the mean valve FAFAV is above 1.02, the learning value is increased to control the air-fuel ratio to rich side, and the mean valve FAFAV is below 0.98, the learning value is decreased to control the air-fuel ratio to lean side, which results that the mean value FAFAV is learning controlled to approach the stoichiometric air-fuel ratio keeping its value as 1.

For example, the air-fuel ratio controller prevents air-fuel ratio feedback correction coefficient from changing and greatly improve transient characteristic of air-fuel ratio control even if the operating condition of the internal combustion engine changes rapidly because the most suitable learning value KG1, KG2 or KG3 is selected to be applied to the above equation (1). In case of secualr change in internal combustion engine characteristic, the mean value FAFAV of air-fuel ratio feedback correction coefficient FAF is invariable remaining in the vicinity of 1.0 and the change of fuel injection time TAU reflected by the secular change is absorbed by the learning value KG.

However, the above air-fuel ratio controller has caused following disadvantages.

Since the learning value KG is finite which is limited in designing control system as well as the feedback correction coefficient FAF, it is necessary for complete absorption of the secular change of the internal combustion engine as abovementioned to adjust the learning value KG to approximately the center value of the variable region in the initial state to be available for the change due to great increase or decrease of KG as much as possible.

Therefore, in the initial operation of the internal combustion engine, sensor output for determining the basic fuel injection time TP in shipment of the vehicle, for example, output from the air-flow meter is controlled to slightly adjust the value of the TP under the same operating condition and to adjust the learning value KG to the required value. That is, in the above equation (1), TP in the right side is varied to adjust KG to the value (generally 1.0) within the required range without varying the calculated fuel injection duration TAU.

The above adjustment is necessary for the initial operation of the internal combustion engine, however, such adjustrment requires a long duration compared with other conventional adjustments.

The learning value KG is determined by learning with the history of the variation of past air-fuel ratio feedback coefficient FAF and the variation of present air-fuel ratio feedback coefficient FAF, which makes it possible to provide reliable learning value KG contained no momentary disturbance. However, since the determination raquires a long-period-observation of the variety of the air-fuel ratio feedback correction coefficient FAF, the above adjustment vaires each variable in the above equation 1.

At first, for example, the output of the air-flow meter is adjusted to varry only the detected results of the sensor keeping factual operating condition of the internal combustion engine constant. Then, intake air-flow amount of internal combustion engine is judged to be varied, which causes the variation of the fundamaental fuel injection duration TP in accord with the variation. Since the acutal operating condition of internal combustion engine does not change, the variation of above TP causes the error of air-flow ratio of which the fuel injection duration TAU has changed. Therefore, the air-fuel ratio feedback correction coefficient FAF is calculated to adjust the detected error of the air-fuel ratio, at the same time, new learning value KG which is within a given range of air-fuel ratio feedback correction coefficient FAF is determined by updating the learning value KG from the observation results of past and present air-fuel ratio feedback correction coefficient FAF. As the determination of new learning value KG requires the period for the completion of learning to the new state, adjusting for the initial determination of the learning value KG has needed a long time. This adjustment not only deteriorates workability and efficiency of the stroke but also has a possibility to wrongly recognize the completing of the adjustment when the incompleted transient learning value KG momentary agrees with the given value, which has made the adjustment one of the most difficult among various ones.

SUMMARY OF THE INVENTION

The primary object of present invention is to provide superior air-fuel ratio controller for an internal combustion engine which can rapidly and accurately detect learning value of the air-fuel ratio feedback correction coefficient in the initial adjustment and rapidly complete the adjustment.

The second object of the present invention is to provide air-fuel ratio controller for the internal combustion engine which can rapidly adjust in the initial adjusting of internal combustion engine by previously obtaining the final learning value before the completion of learning to greatly improve workability of internal combustion engine adjustment and quality by highly ensuring its reliability.

The third object of the present invention is to propose the air-fuel ratio controller for the internal combustion engine which can eliminate the necessity of alternative device for the initial adjustment for the internal combsution engine and simplify the initial adjustment.

The fourth object of the present invention is to provide air-fuel ratio controller for the internal combsution engine which avoids to wrongly recognize the value in the transient while the learning value KG varies as the final one.

An apparatus of controlling an air-fuel ratio for internal combustion engine, further comprising means for calculating a basic fuel injection duration based on an engine load and a rotational speed of the engine, obtaining a factor of air-fuel ratio feedback correction for allowing a fuel injection duration to perform a proportional-plus-integral action, based on an output of an oxygen sensor for detecting an residual oxygen concentration in an exhaust gas, calculating a mean value of said factor of air-fuel ratio feedback correction, varying a correction value by learning so that said mean value takes a value within apredetermined range centered at a predetermined value corresponding to a target air-fuel ratio, multiplying the mean value by the correction value, providing initial adjustment of load detection apparatus applied to said internal combustion engine for determining said basic fuel injection time duration in order to set said calculation result within said predetermined range, and obtaining the fuel injection duration based on said basic fuel injection duration, said factor of air-fuel ratio feedback correction and said correction value, thereby, to control the air-fuel ratio.

In the present invention, the multiplication of the air-fuel ratio feedback correction coefficient and the learning value as the information for the adjustment has a physical meaning as mentioned below.

In order to keep operating conditions of an internal combustion engine invariable and operate the internal combustion engine with the constant air-fuel ratio, fuel injection duration TAU is necessary to be kept constant. Therefore, if the operating condition is kept invariable while the feedback control is in the operation in accordance with the output from an oxygen sensor instead of using throttle valve, TAU is stable in constant value. That is, under the operating state as mentioned above, the result of the calcuration of the right side in the above equation 1 is to be a constant value TAU. Under the condition, enough passage of the duration remains air-fuel ratio feedback correction coefficient FAF stable to approximately a given value FA by the learning value KGA. If the learning value KGA which is not a required value is varied to the required value KGB, TP in the right side of the equation is varied to TP', that is, the output from the load-detecting device of the internal combustion engine which is fundamental for calculating TP is adjusted. However, this means that an apparent load to the air-fuel ratio controller is varied and an actual load to the internal combustion engine is invariable. Since the result of the calcuration TAU in the left side of the equation 1 is invariable, it is obvious that the following equation is formed:

$$TAU = TP' \times FAFB \times KGB = TP \times FAFA \times KGA \quad (3)$$

In equation 3, the learning value KGB to varied TP' is learned and updated to adjust the air-fuel ratio correction coefficient FAFB to the given value FAFA resulting the following equation of FAFB=FAFA. However, the learning value KGB requires enough time for learning until it is learned and updated resulting the following equation of FAFB=FAFA.

In the transition of the above state, to recognize the value KGB in which the learning value KG becomes stable in short period, the multiplication of air-fuel ratio correction coefficient FAF and the learning value KG is observed. That is, the value of KGB×FAFBS varies to the state of FAFB= FAFA keeping the relation of KGB×FAFB =C (C is invariable) and the final value of the air-fuel ratio feedback correction coefficient, FAFA is already known. Therefore, the value of KGB×FAFB stands for the multiplication of the learning value in the final static state and the preset value of the known air-fuel ratio feedback correction coefficient.

If the multiplication is computed to be adjusted so that the value is within the preset range, the static learning value after the transition and the rapid adjustment can be obtained.

DETAILED DESCRIPTION OF THE PREFERRED EMBODIMENT FOR THE INVENTION

Figure 1:
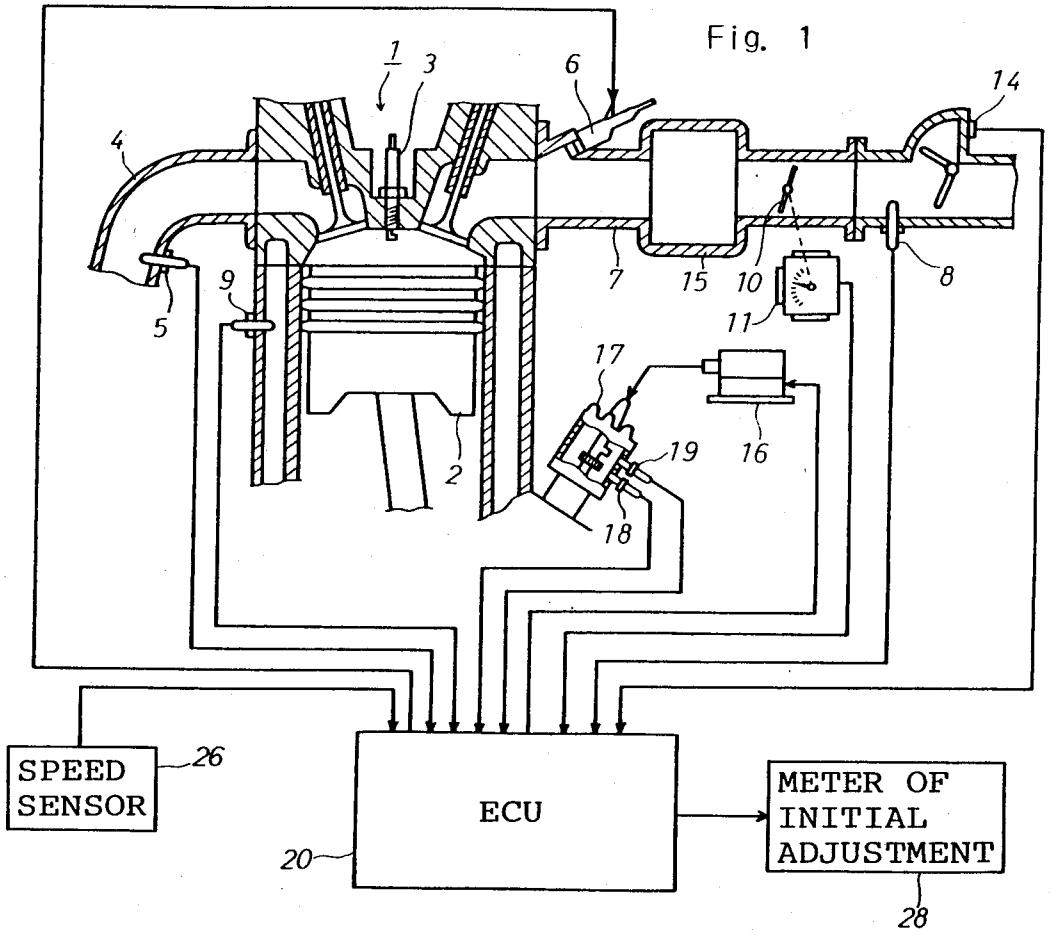
FIG. 1 is a constitutional schematic view of an internal combustion engine system embodying the invention.

FIG. 1 shows a descriptive view of a gasoline engine system applied to the present invention.

Numeral 1 denotes the body of the gasoline engine. Numeral 2 denotes a piston. Numeral 3 denotes a spark plug. Numeral 4 denotes an exhaust manifold. Numeral 5 denotes an oxygen sensor which is installed in the exhaust manifold 4, and detects the residual oxygen concentration in the exhaust gas. Numeral 6 designates a fuel injection valve which injects fuels into the intake air in the internal combustion engine 1. Numeral 7 denotes an intake manifold. Numeral 8 denotes an intake-air temperature sensor which reads the temperature of the intake air to be transfered to the internal combustion engine 1. Numeral 9 denotes a water temperature sensor which detects the temperature of the internal combustion engine cooling water. Numeral 10 denotes a throttle valve which adjusts the intake air amount. Numeral 11 denotes a throttle position sensor which detects the position of the throttle valve 10. Numeral 14 denotes an air-flow meter which measures the intake air amount. Numeral 15 denotes a surge tank which absorbs the pulsation of the intake air. Numeral 16 denotes an igniter which generates high power voltage required for ignition. Numeral 17 denotes a distributor which interlocks with a crankshaft which is not illustrated here to distribute high power voltage generated by the above ignition 16 to the spark plug 3 in each valve. Numeral 18 denotes a crank angle sensor installed in the distributor 17 to provide one revolution of the distributor 17, more particular, twenty four pulse signals per two revolutions of the crankshaft. Numeral 19 is a valve judging sensor which provides one pulse signal per one revolution of the distributor 17. Numeral 20 denotes an electronic contrtolled circuit. Numeral 26 denotes a speed sensor which interlocks with the axle to provide required pulse signal for the speed. Numeral 28 denotes a meter of initial adjustment which is connected in the initial adjustment to input the output for adjustment from the electronic controlled circuit 20 and shows (or indicates) the internal information to aid the inital adjustment of the electronic controlled circuit 20.

Figure 2:
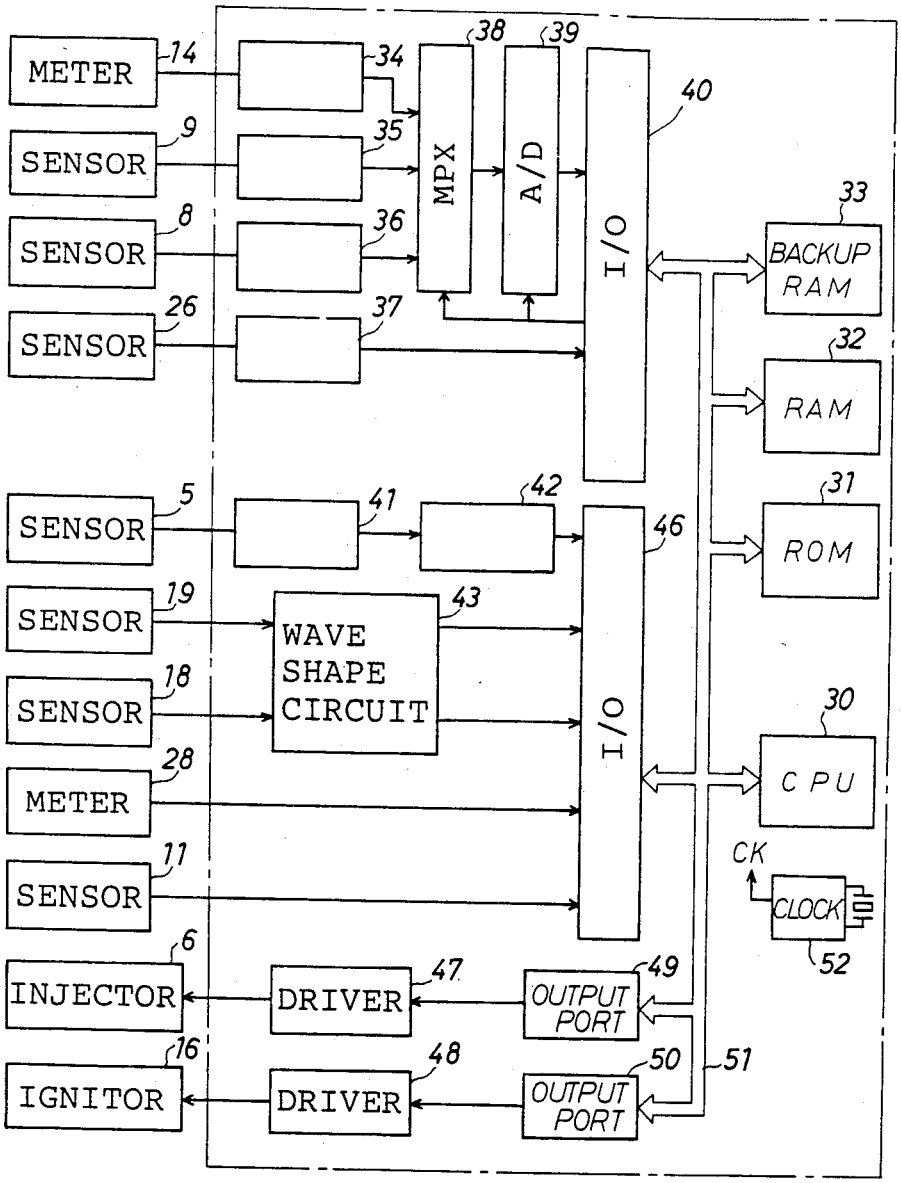
FIG. 2 is a block diagram of the control system.

Next, FIG. 2 illustrates a block diagram of the electronic controlled circuit 20 and its related parts.

Numeral 30 denotes the Central Processing Unit (CPU) to enter and calculate the data output from each sensor according to the control program and execute the required processes for operation and control of each unit. Numeral 31 denotes the Read Only Memory (ROM) which stores the control programs and the initial data. Numeral 32 denotes the Random Access Memory (RAM) where the data to be entered into the electronic control circuit 20 and the data required to the operational control are temporarily read and written out. Numeral 33 denotes the backup Random Access Memory (backup RAM) as a non volatile memory which is backed up by battery to maintain the required data for the operation of the internal combustion engine after the key switch which is not illustrated here is to be off. Numeral 34 thru 37 denote the buffer of generated signals from each sensor. Numeral 38 denotes a multiplexer which selectly generates the output signal of each sensor to the CPU 30. Numeral 39 denotes an A/D converter which converts the analog signal to the digital one. Numeral 40 denotes an I/O port which sends each sensor signal to the CPU via the buffer or the buffer, the multiplexer 38, and the A/D converter 39 and generates control signal of the multiplexer 38 and the A/D converter 39 from the CPU 30.

Numeral 41 denotes a buffer which sends the output signal of the oxygen sensor 5 to a comparator 42. Numeral 43 shows a wave shape circuit which regulates the wave shape of the output signal from the crank angle sensor 18 and the valve judging sensor 19. An operational siganl of the output of the throttle position sensor 11 is sent directly or via the buffer 41 through the I/O port 46 to the CPU 30.

Furthermore, numeral 47 and 48 denote drivers which drive the fuel injection valve 6 and the igniter 16 by the signal from the CPU 30 via the I/O ports 49 and 50. Numeral 51 denotes a busline which is a passage of the signal or the data. Numeral 52 denotes a clock circuit which sends clock signals to the CPU 30, ROM 31, and RAM 32 at the preset intervals.

Figure 3:
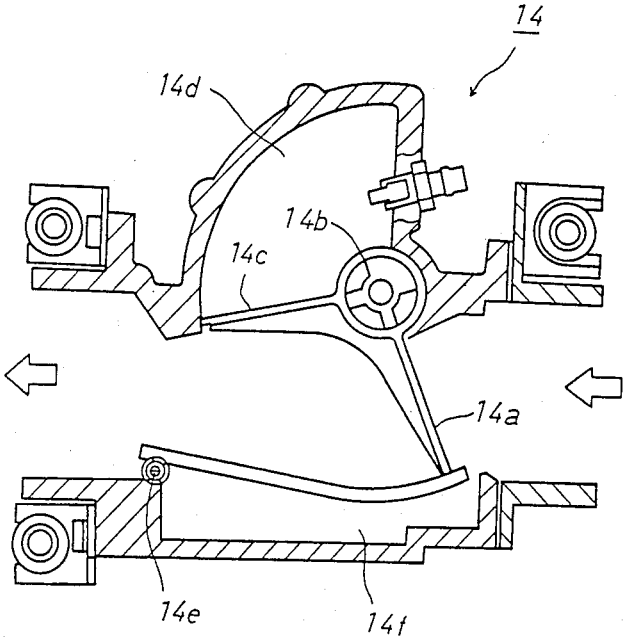
FIG. 3 is a detailed constitutional view of a constitution of the air-flow meter.

FIG. 3 shows the detailed view of the constitution of the air-flow meter 14. Since the measuring plate **14*a* rotates on the axle 14*b* according to flowing air amount as indicated with an arrow in the FIG. 1, the intake air amount Q of the gasoline engine 1 can be detected by detecting the crank angle. 14*c* denotes a convensation plate generating the torque which resistes the rotation of the measuring plate 14*a* in the damping chamber 14*d* to improve the response to the crank angle of the measuring plate 14*a* and operate the intake of the pulsation. 14*e* is an adjusting screw which varies the bypass air amount that is not influential in the revolution of the measuring plate 14*a* passing the bypass passage 14*f*. Various measuring instruments, as well as the air-flow meter 14, are necesary to be adjusted when they are incorporated to the system due to the ununiformity of them. The adjusting screw 14*e* controls the bypass air amount to make the detected value of the air-flowmeter 14** to be the best for the system.

Figure 4:
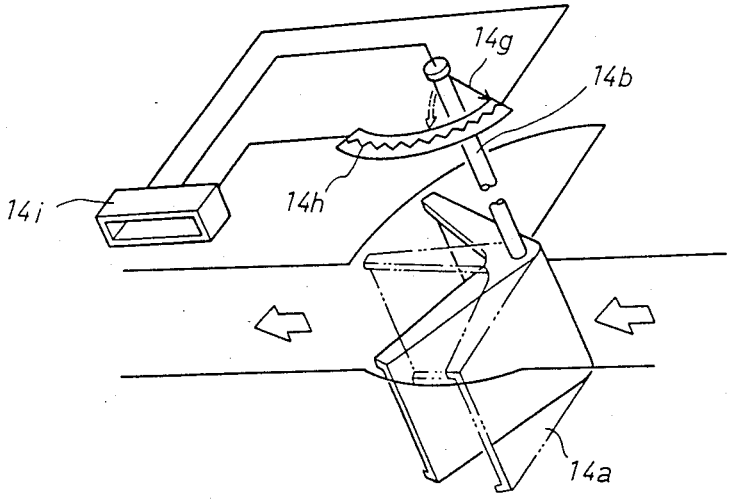
FIG. 4 is a description of the output of the air-flow meter.

FIG. 4 is a conceptual view of the air-flow meter. As the figure shows, revolution of the measuring plate **14*a* moves 14*g* bonded to the axle 14*b* on the resistance wire 14*h* in touch with the axle and transfer the change of the resistance to the electric control circuit 20 via the connector 14*i*** thereby to enable the electric control circuit 20 to detect the air amount Q intook to the gasoline engine 1.

The air fuel ratio control operated by the internal combustion engine having the above constitution is described.

Figure 5:
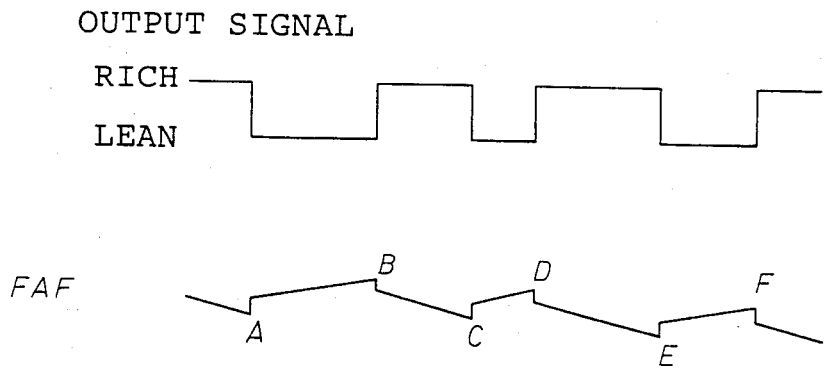
FIG. 5 is a descriptive view of the air-fuel feedback controller.

The oxygen sensor 5 detects the residual oxygen concentration in the exhaust manifold to control the fuel amount injection supplied so that the concentration is to be the required value, stoichiometric air-fuel ratio, which is well-known as the air-fuel ratio feedback control. The control remains the air-fuel ratio to be the required value by adjusting the opening valve duration of the fuel injeciton vlave 6. FIG. 5 is the explanatory view of the control. when the oxygen sensor 5 detects whether the present air-fuel ratio is rich or lean state compared with the stoichiometric air-fuel ratio, the air-fuel ratio feedback correction coefficient FAF is determined in accord with the detected result as shown in said figure.

The determined FAF is applied to the following equation to calculate the fuel injection time TAU.

$$TAU = TP \cdot FAF \cdot KGn \cdot (1 + F(t)) + \tau \quad (4)$$

where TP stands for the basic fuel injection duration determined by the intake air amount Q and engine speed Ne, KGn (n=1, 2, . . . 5) stands for the learning value determined in accord with the region of the intake air amount Q which is devided in multiple, for example, as shown in Table 1. FAF means an air-fuel feedback correction coefficient,

TABLE 1

| intake air amount Q | KGn |
|---|---|
| Q < 15 l/h | KG1 |
| 15 l/h = < Q < 30 l/h | KG2 |
| 30 l/h = < Q < 45 l/h | KG3 |
| 45 l/h = < Q < 60 l/h | KG4 |
| 60 l/h = < Q | KG5 |

F(t) means various correction coefficients to increase the fuel amount in the starting or the cold period. $\tau$ means non-effective injection duration for the voltage compensation.

The above F(t) is set to be the plus preset value in the period of accerelation or cooling. In the stable state, the value is to be 0. The above learning value KGn is learned with the learning routine of FIG. 6 as described below to be applied the above equation 4 in the learned region.

Figure 6:
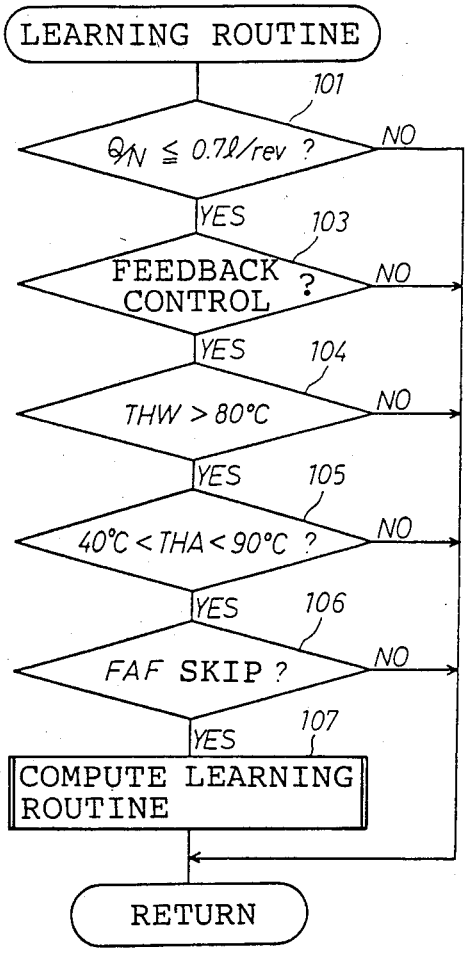
FIG. 6 is a flowchart of the learning routine.

The learning routine to correct the learning value KGn is described in reference to the FIG. 6. In the step 101, intake air amount per one revolution Q/Ne is judged to be less than 0.71/rev or not, in other words, Q/Ne, the load of the engine 1 is judged to be within the learning range or not. If the Q/Ne is less than 0.71/rev to be within the learning range in the step 101, the learning condition below the step 103 are judged to obtaine the learning value. If the Q/Ne is more than 0.71/rev to be out of the learning range, the following routine is to be proceeded without learning.

In the step 103, the air-fuel ratio is judged whether it is feedback controlled to be the stoiciometric air fuel ratio in accord with the output signal of the oxygen sensor 5 or not. In case not in feedback control, for example in the lean controling, the following routine is proceeded with no learning because the wrong learning is operated. In case in feedback control, in the step 104, cooling water temperature THW is judged to exceed the preset value (for example 80° C.) or not. If the cooling water temperature THW is below the preset value, the engine is in the state of warming up and the learning is not done due to the plus value of the above F(t). If the cooling water temperature THW exceeds the preset value, in the step 105, intake temperature THA detected by the intake temperature sensor is detected to be within the preset range (for example, 40° C.< THA<90° C.) or not. In the extreme low or high temperature, if the absorbing temperature THA is out of the preset range, the learning is not operated, if the absorbing temperature THA is within the preset range, the step 106 judges whether the air-fuel ratio feedback correction coefficient FAF skips or not, and when it skips, step 107 operates to obtain the learning value.

Figure 7A:
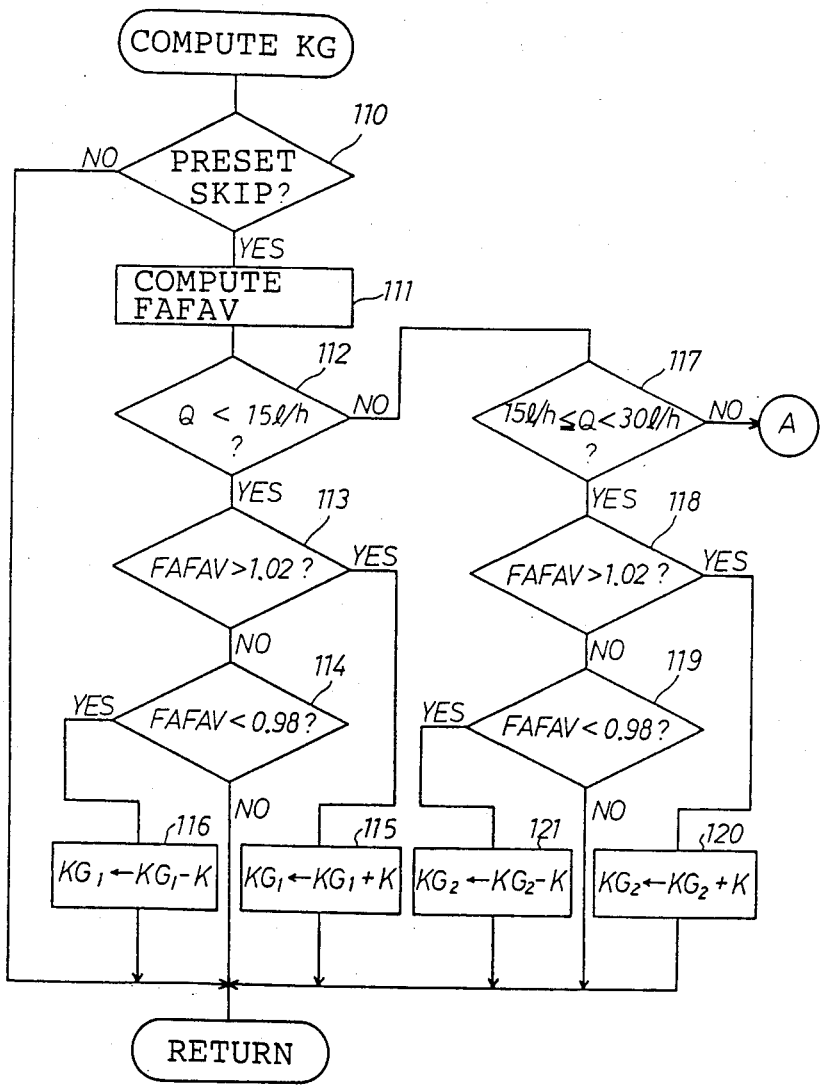
FIGS. 7 A–C are flowcharts of the calculation for the learning value.
Figure 7B:
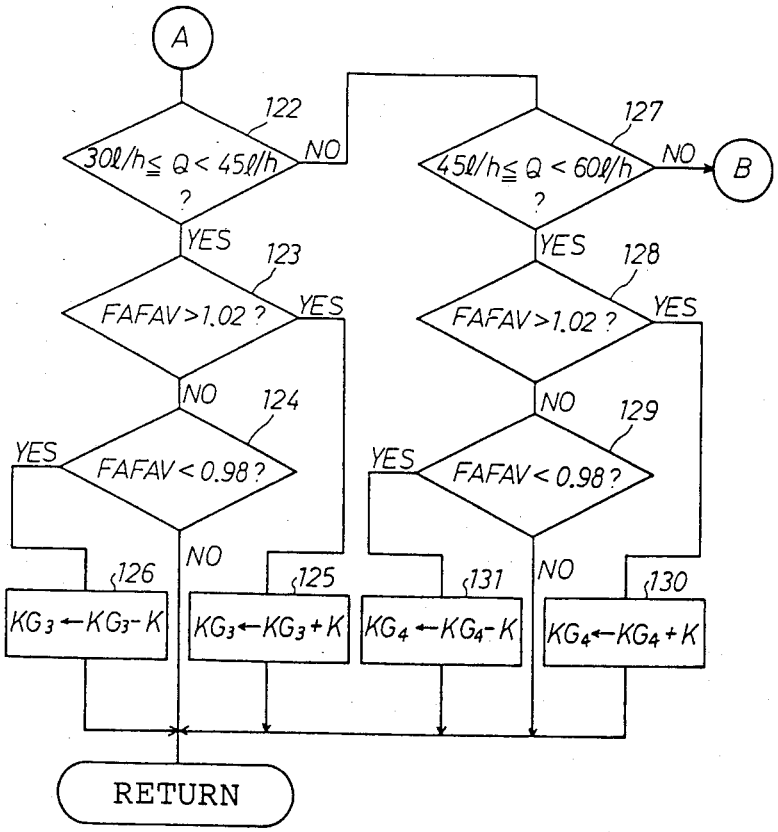
Figure 7C:
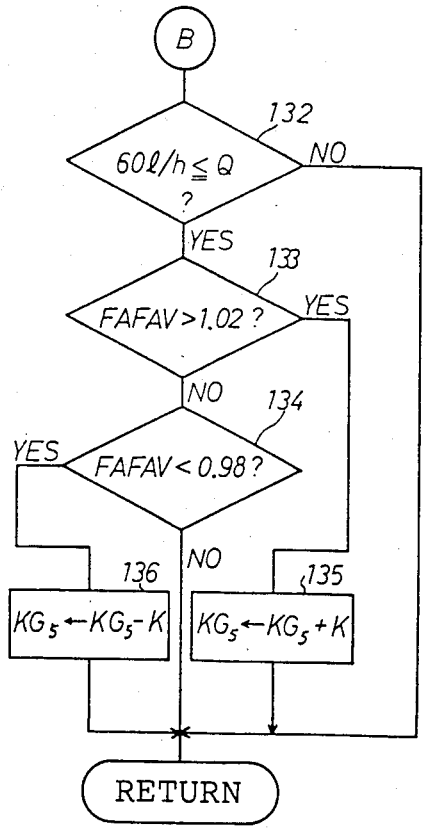

One example of calculation of the learning value in the above mentioned step 107 is described in reference to the FIG. 7. The step 110 judges whether the air-fuel feedback correction coefficinet FAF skips at desired times, only when it skips the desired times, the step 111 calculates the mean value of FAFAV on the basis of the above equation 2. Since the variation of the air-fuel ratio feedback correction coefficient is unstable immediately after the transfer from the lean control as the open loop control to the feedback control, the mean value is calculated after the skip at the desired time. Thus, unstable air-fuel ratio feedback correction coefficient is used for the calculation.

The following step 112 judges whether the intake air amount Q is below 15 l/h or not, if the intake air amount Q is above 15 l/h, step 113 judges whether the mean value FAFAV exceeds the upper limited value (for example, 1.02) within the preset range comprising the value corresponding to the stoichiometric ratio, and, at the same time, the step 114 judges whether the mean value FAFAV is below the lower limited value (for example, 0.98) within the preset range. If the mean value FAFAV exceeds the upper limited value, step 115 increases the learning value KG1 to the preset value K (for example 0.005). If the mean value FAFAV is less than the lower limited value, step 116 decreases the learning value KG1 to the preset value K. As well as the learning value KG1, the learning value KG2 is learned in the steps from 117 to 121, the learning value KG3 is learned in the steps from 122 to 126, the learning value KG4 is learned in the steps from 127 to 131 and the learning value KG5 is learned in the steps from 132 to 136, respectively.

As a result, the learning value KGn (KG1–KG5) is learned and updated respectively so that the mean value FAFAV of the air-fuel ratio feedback correction coefficient is to be the value within the preset range. The results are stored in the backup RAM 33 to be read out, substituted for the above equation 4 and used for calculating TAU.

The above air-fuel ratio controller enables to calculate the optimum TAU in the equation 4.

Figure 8:
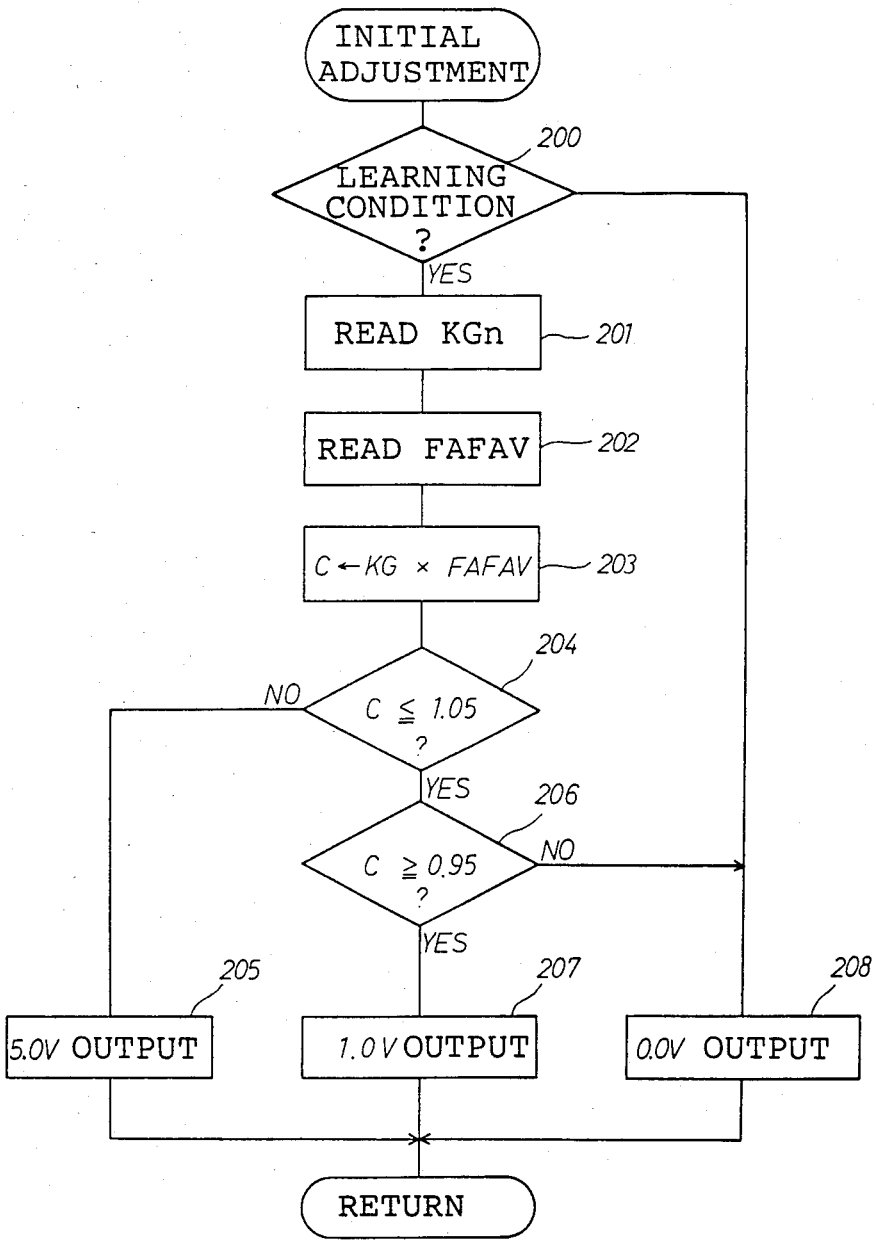
FIG. 8 is a flowchart of the output routine for the initial adjustment.

Next, the initiallization of the air-fuel ratio controller operating the above air-fuel ratio controlling is described. The electric control circuit 20 has the program in the ROM 31 to generate the required information for the initial adjustment by itself. The output routine for the initial adjustment is shown in the FIG. 8. Entering CPU 30 in controlling the routine, the condition which updates the preset learning value in the step 200, more particular, whether the routine of the FIG. 7 is under the operating condition or not. The learning condition is formed to operate the following process only when the update of the newest learning value is on, otherwise, the step 208 described below is executed to terminate the routine. The step 201 reads and processes the most updated learning value KGn from the backup RAM 33. The step 202 reads the mean value FAFAV of the air-fuel correction coefficient FAF and set the multiplication of these two values to variable C. (step 203). The following 204 step judges whether or not the C is less than 1.05. If C> 1.05, output of 5.0 v is generated on the instrument for the initial adjustment 28 via the I/O port 46 executed the process of the step 205. If C= <1.05, the following step 206 is proceeded. The step 206 judges whether C>=0.95 or not. If C>=0.95, that is, 1.05>=C>=0.95, the step 207 generates the output of 1.0 V via the I/O port 46 and if C<0.95, step 208 is selected to generate the output of 0.0 V. As shown in FIG. 7, the learning value KGn is determined so that the air-fuel feedback correction coefficient FAF is to be within a range of 0.98 to 1.02. The learning value KGn is within a range of about 0.93 to 1.07, 1.0 V is generated by the I/O port 46. If it is less than 0.93, or more than 1.07, 0.0 V and 5.0 V is generated, respectively. As it is obvious from the calculation program of the learning value in FIG. 7, that the mean value FAFAV of the air-fuel feedback correction coefficient finally results to be within a range of 0.98 to 1.02 and the value by the multiplication of FAF and KG is necessary to be constant in the equation 4. Therefore, the outputs of 0.0 V, 1.0 V and 5.0 V are all determined only by the learning value KG. The instrument for the initial adjustment 28 which inputs the three kinds of outputs indicates the direction of adjusting screw **14*e* in FIG. 4 in accord with voltage value of the input. That is, the input of 0.0 V means the learning value KG is smaller than the required value, which is caused by great value of TP in the equation 4. To reduce the TP, the adjusting screw 14*e* of he air-flow meter is rotation to the open side to reduce the crank angle of the measuring plate 14*a* so that the apparent intake air amount is reduced. At the same time, in case of the output of 5.0 V, the adjusting screw 14*e*** is indicated to be revolute to the closed side and in case of the output of 1.0 V, the state of good adjustment is informed.

What is claimed is:

1. An apparatus of controlling an air-fuel ratio for internal combustion engine comprising:

(a) means for calculating a basic fuel injection duration based on an engine load and a rotational speed of the engine;

(b) means for obtaining a factor of air-fuel ratio feedback correction for allowing a fuel injection duration to perform a proportional-plus-integral action, based on an output of an oxygen sensor for detecting an residual oxygen concentration in an exhaust gas;

(c) means for calculating a mean value of said factor of air-fuel ratio feedback correction;

(d) means for varying a correction value by learning so that said mean value takes a value within a predetermined range centered at a predetermined value corresponding to a target air-fuel ratio;

(e) means for multiplying said mean value by said correction value;

(f) means for providing initial adjustment of load detection apparatus applied to said internal combustion engine for determining said basic fuel injection time duration in order to set said calculation result within said predetermined range, and (g) means for obtaining the fuel injection duration based on said basic fuel injection duration, said factor of air-fuel ratio feedback correction and said correction value, thereby, to control the air-fuel ratio.

2. A method of controlling an air-fuel ratio for internal combustion engine, comprising the steps of:

(a) calculating a basic fuel injection duration based on an engine load and a rotational speed of the engine;

(b) obtaining a factor of air-fuel ratio feedback correction for allowing a fuel injection duration to perform a proportional-plus-integral action, based on an output of an oxygen sensor for detecting an residual oxygen concentration in an exhaust gas;

(c) calculating a mean value of said factor of air-fuel ratio feedback correction;

(d) varying a correction value by learning so that said mean value takes a value within a predetermined range centered at a predetermined value corresponding to a target air-fuel ratio;

(e) multiplying said mean value by said correction value;

(f) providing initial adjustment of load detection apparatus applied to said internal combustion engine for determining said basic fuel injection duration in order to set said calculation result within said predetermined range, and (g) obtaining the fuel injection duration based on said basic fuel injection duration, said factor of air-fuel ratio feedback correction and said correction value, thereby, to control the air-fuel ratio.

3. A method of controlling an air-fuel ratio for internal combustion engine as claimed in claim 2, wherein said step of varying said correction value comprising:

increasing correction value when said mean value exceeds the upperlimit value of said predetermined range, and decreasing correction value when said mean value is less than the lowerlimit value of said predetermined range.

4. A method of controlling an air-fuel ratio for internal combustion engine as claimed in claim 2 wherein said step of varying said correction value comprising:

updating said correction value to be learned at the preset interval by load of said internal combustion engine.

* * * * *